US011064273B2

(12) United States Patent
de la Fuente

(10) Patent No.: US 11,064,273 B2
(45) Date of Patent: Jul. 13, 2021

(54) DEVICE ENCLOSURE WITH INTEGRATED SPEAKER HOUSING

(71) Applicant: Google LLC, Mountain View, CA (US)

(72) Inventor: Valentin de la Fuente, San Jose, CA (US)

(73) Assignee: Google LLC, Mountain View, CA (US)

( * ) Notice: Subject to any disclaimer, the term of this patent is extended or adjusted under 35 U.S.C. 154(b) by 133 days.

(21) Appl. No.: 16/124,440

(22) Filed: Sep. 7, 2018

(65) Prior Publication Data

US 2020/0084525 A1 Mar. 12, 2020

(51) Int. Cl.

| | |
|---|---|
| ***H04R 5/02*** | (2006.01) |
| ***H04R 1/02*** | (2006.01) |
| ***H01Q 1/22*** | (2006.01) |

(52) U.S. Cl.

CPC ..... *H04R 1/02* (2013.01); *H01Q 1/22* (2013.01); *H04R 2420/07* (2013.01); *H04R 2499/11* (2013.01); *H04R 2499/15* (2013.01)

(58) Field of Classification Search

CPC ..... H04R 1/02; H01Q 1/22
USPC ..... 381/386–388; 455/575.1, 348
See application file for complete search history.

(56) References Cited

U.S. PATENT DOCUMENTS

| | | | | |
|---|---|---|---|---|
| 4,227,258 | A * | 10/1980 | Root | H04B 1/3827 455/348 |
| 5,628,055 | A * | 5/1997 | Stein | H04B 1/38 455/575.1 |
| 9,178,268 | B2 | 11/2015 | Zhu et al. | |
| 9,444,131 | B2 | 9/2016 | Uttermann et al. | |
| 9,748,635 | B2 | 8/2017 | Dabov | |
| 10,162,390 | B2 * | 12/2018 | Sweet | G06F 1/1688 |
| 2012/0114163 | A1 * | 5/2012 | Yang | H01Q 1/243 381/386 |
| 2012/0194998 | A1 | 8/2012 | McClure et al. | |
| 2016/0212892 | A1 | 7/2016 | Sweet et al. | |

FOREIGN PATENT DOCUMENTS

| | | | |
|---|---|---|---|
| EP | 1758348 | A2 | 2/2007 |
| WO | 2007086669 | A1 | 8/2007 |
| WO | 2011151675 | A1 | 12/2011 |

OTHER PUBLICATIONS

International Search Report and Written Opinion for Application No. PCT/US20191045728, dated May 28, 2020, 13 pages.

* cited by examiner

*Primary Examiner* — Md S Elahee
(74) *Attorney, Agent, or Firm* — Brake Hughes Bellermann LLP

(57) ABSTRACT

A speaker module is described that includes a first sidewall opposite a second sidewall. The first sidewall may form a radio frequency transmissive window and the second sidewall may include at least one port aperture to receive an electrical connection for at least one speaker. The speaker may also include a first end wall opposite a second end wall in which the first end wall is configured to integrate a flexible antenna element for receiving radio frequency signals through the radio frequency transmissive window. The first sidewall, the second sidewall, the first end wall, and the second end wall form an enclosure to house the at least one speaker.

18 Claims, 11 Drawing Sheets

DEVICE ENCLOSURE WITH INTEGRATED SPEAKER HOUSING

TECHNICAL FIELD

This disclosure relates generally to a computing device, and, more particularly, to a computing device having an integrated speaker module as a cosmetic member and structural member of a device housing.

BACKGROUND

Electronic devices may include a display encased in material for protecting the components of the display. The material of the encasement of the electronic devices may be selected depending on a targeted usage environment. For example, if the electronic devices are targeted to be used near large bodies of water, the selected encasement material may be selected from known waterproof materials that enable a tight seal to ensure the display and the device are free from water damage. Selecting a material of a device encasement based on the targeted usage environment enables such a device to include tailored features for each specific environment.

SUMMARY

In a first general aspect, a speaker module is described that includes a first sidewall opposite a second sidewall. The first sidewall may form a radio frequency transmissive window and the second sidewall may include at least one port aperture to receive an electrical connection for at least one speaker. The speaker may also include a first end wall opposite a second end wall in which the first end wall is configured to integrate a flexible antenna element for receiving radio frequency signals through the radio frequency transmissive window. The first sidewall, the second sidewall, the first end wall, and the second end wall form an enclosure to house the at least one speaker.

Implementations may include one or more of the following features. The speaker module may further include a front wall opposite a rear wall and the front wall may include an aperture opening to receive the at least one speaker. The rear wall may be configured to provide structural support for a rear surface of an electronic device housing.

In some implementations, the first sidewall includes a first curved sidewall portion and a second curved sidewall portion. The second curved sidewall portion may be aligned parallel to the first curved sidewall portion to form the radio frequency transmissive window. The first curved sidewall portion may support a display cover glass of an electronic device housing and the second curved sidewall portion may support a conductive rear surface of the electronic device housing. The speaker module may provide at least a decorative edge for an electronic device housing, a structural support member for the electronic device housing, a structural support member for a display device seated in the electrical device housing, and at least one mounting member for the flexible antenna element. The radio frequency transmissive window of the speaker housing may be integrally formed with a metal enclosure to form a continuous edge of an electronic device housing. The flexible antenna element includes a flexible cable mounted to the speaker module on the first end wall.

In a second general aspect, a portable electronic device is described. The portable electronic device includes at least one processor configured to access memory, at least one communications interface, at least one transceiver configured to send and receive wireless signals, at least one flexible antenna element, a display, and a speaker mounted in a speaker module. The portable electronic device also includes a first enclosure housing the speaker module, the enclosure including, a first sidewall opposite a second sidewall, the first sidewall forming a curved radio-frequency-transparent element and the second sidewall including at least one port aperture to receive an electrical connection. The enclosure also includes a first end wall opposite a second end wall, the first end wall configured to integrate the flexible antenna element for receiving radio frequency signals through the curved radio-frequency-transparent element, wherein the first sidewall, the second sidewall, the first end wall, and the second end wall form the first enclosure to house the at least one speaker. The portable electronic device also includes a second enclosure configured to receive the first enclosure, the second enclosure integrating the first sidewall of the first enclosure into a cavity formed by a beveled edge of the second enclosure.

Implementations may include one or more of the following features. The portable electronic where the first sidewall includes a first curved sidewall portion a second curved sidewall portion. The second curved sidewall portion may be aligned parallel to the first curved sidewall portion to form the radio-frequency-transparent element. The first curved sidewall portion may be configured to support a display cover glass of the portable electronic device. The second curved sidewall portion may be configured to support a conductive rear surface of the portable electronic device. In some implementations, the speaker module provides at least a decorative edge for the portable electronic device, a structural support member for the portable electronic device, a structural support member for the display seated in the portable electronic device, and at least one mounting member for the flexible antenna element. In some implementations, the portable electronic device also includes a rear surface coupled to the first enclosure and the second enclosure to provide structural support for the display, the first enclosure and the second enclosure. In some implementations, the first enclosure is constructed of a non-conductive material that allows radio frequency signals to be transmitted to the flexible antenna element while the second enclosure is constructed of a conductive material. In some implementations, the first enclosure and the second enclosure are coupled to form at least one continuous decorative edge of the portable electronic device.

In some implementations, the flexible antenna element comprises a cable mounted to the speaker module. The flexible antenna element may be arranged to receive radio frequency signals through the radio-frequency-transparent window. In some implementations, the first enclosure includes at least one cavity housing a speaker configured to amplify sound signals for the portable electronic device. In some implementations, the second enclosure is composed of metal and the radio-frequency-transparent element is integrally formed with the second enclosure to form a continuous edge of the electrical device housing.

In a third general aspect, an enclosure for a portable computing device is described. The portable computing device may include a first cover portion having a first curved sidewall portion and a second cover portion having a second curved sidewall portion. The second curved sidewall portion may be aligned with the first curved sidewall portion to form a continuous sidewall. The second cover portion may include a radio frequency transmissive window on an edge of the second cover portion. The radio frequency transmissive window is coupled to a speaker module housed in the enclosure to form a portion of the edge of the enclosure.

Implementations may include one or more of the following features. In some implementations, the enclosure is composed of conductive material and the radio frequency transmissive window is composed of non-conductive material. In some implementations, the radio frequency transmissive window may extend in a direction along a longitudinal line along the portion of the edge of the enclosure. In some implementations, the first curved sidewall portion has a first radius of curvature, the second curved sidewall portion has a second radius of curvature, and the radio frequency transmissive window has a third radius of curvature to complement the first radius of curvature and the second radius of curvature to form the continuous sidewall portion. In some implementations, the second radius of curvature is the same as the first radius of curvature. In some implementations, the radio frequency transmissive window is aligned to house a flexible antenna element arranged to receive radio frequency signals through the radio frequency transmissive window. In some implementations, the radio frequency transmissive window is integrally formed on a sidewall of a speaker module of the portable computing device and is configured to form a continuous edge of the enclosure when the speaker module is installed into the portable computing device.

The details of one or more implementations are set forth in the accompanying drawings and the description below. Other features will be apparent from the description and drawings, and from the claims.

BRIEF DESCRIPTION OF THE DRAWINGS

The use of similar or identical reference numbers in the various drawings is intended to indicate the presence of a similar or identical element or feature.

DETAILED DESCRIPTION

Figure 1A:
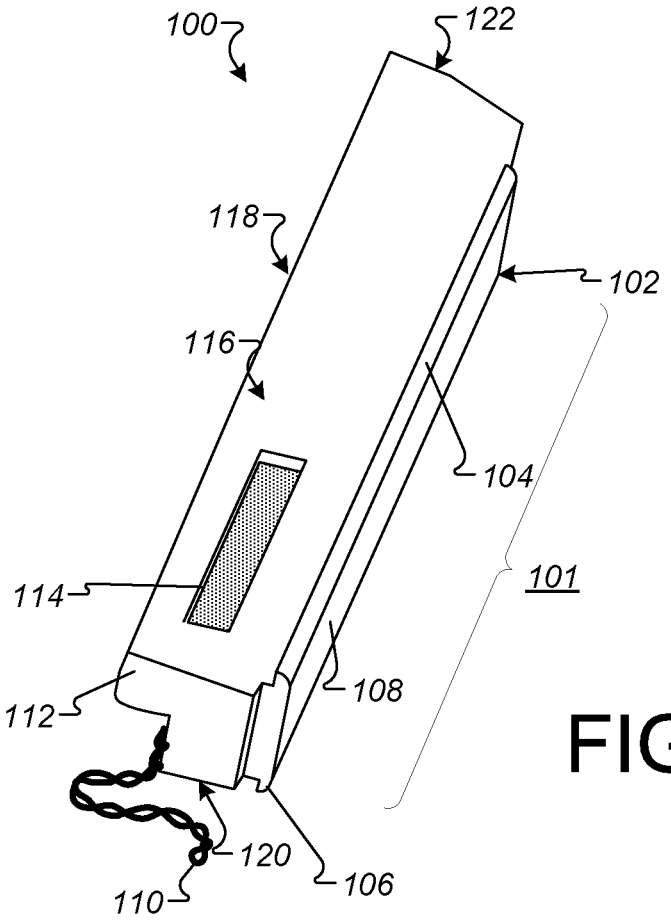
FIG. 1A is a perspective view of a speaker module in accordance with implementations described herein.

Premium electronic devices may be constructed of any number of materials. For example, some premium electronic devices may be constructed with metal enclosures. However, as the limits of form factor are pushed in terms of minimizing borders and maximizing display size, consumers may benefit from an electronic device designed with a portion of the enclosure in a different material to both shrink the device footprint and provide for improved device functionality. For example, a portion of the device enclosure may be manufactured to be a non-conductive material that abuts the metal (e.g., conductive) portions of the enclosure. The non-conductive portion of the device enclosure may be configured from materials that are radio frequency transmissive to ensure that antennas onboard an encased electronic device are able to radiate outwards. In order to allow for outward radiation from the non-conductive portion (e.g., window, aperture, etc.) of the enclosure, the non-conductive portion of the enclosure may be constructed of plastic, glass, quartz, or other radio frequency transmissive (e.g., radio-frequency-transparent) material. To minimize device size, the non-conductive portion may be integrated into an internal component of the device and arranged to form a portion of the outer enclosure of the device.

The implementations described throughout this disclosure may include one or more integrated radio frequency transmissive windows into one or more functional components of an electronic device. For example, a radio frequency transmissive window may be integrated into an internal component of the electronic device while also providing a cosmetic edge (e.g., bezel) of the electronic device when the integrated internal component is assembled to an enclosure of the electronic device. Thus, the internal component may have the integrated radio frequency transmissive window to enable the internal component to function as a cosmetic window of the electronic device and a structural support for a display (and/or other components) of the electronic device. In some implementations, the internal component with the integrated radio frequency transmissive window may additionally provide a structural support and/or mounting point for an antenna that may utilize the transmissivity of the window to communicate radio signals to and from an electronic device associated with the antenna.

In some implementations, the internal component having an integrated radio frequency transmissive window may be a speaker module. The speaker module may include the transmissive window and may be coupled to one or more other components of an electronic device. For example, the radio frequency transmissive window may be integrated into a speaker module to provide a cosmetic edge of the electronic device when the integrated speaker module is assembled to an enclosure of the electronic device. Thus, the speaker module may include the window as a part of the speaker housing which may enable the speaker module to function as a cosmetic window of the electronic device completing the enclosure and providing a structural support for a display associated with the device.

Implementations of the devices described herein can provide advantages over conventional devices. For example, integrating the radio frequency transmissive portion into one or more components can allow formation of a seamless enclosure of the electronic device. For example, a radio frequency transmissive portion of a speaker module (i.e., housing) may be configured to fit in an aperture of a portable electronic device to provide a continuous edge of a housing for the device. The continuous edge may provide a cosmetic surface of at least one edge of the portable electronic device. In some implementations, the continuous edge surrounds an entire border of the portable electronic device. For example, the radio frequency transmissive portion of the speaker module may be fitted to the portable electronic device housing to allow the edge of the portable electronic device to seamlessly flow from conductive material to non-conductive material (e.g., metal to plastic) in one or more areas of the housing. There is no need to form a window (e.g., non-conductive portion) as a separate manufactured part or to inline mold such a part because the speaker module, which is installed into the portable electronic device during manufacturing, provides the transmissive window, the decorative edge, a portion of the portable electronic device housing, and a support structure.

In some implementations, integrating a radio frequency transmissive window into an internal component of the electronic device may provide the advantage of reducing a footprint and/or thickness of the device. For example, the integration of the radio frequency transmissive window into an internal component of the device may allow for reducing device thickness, thus reducing one or more wall thicknesses and/or device border size. In addition, integrating multiple parts into a single part may reduce a number of components utilized in manufacturing of such electronic devices, which may reduce device production cost and/or manufacturing cost.

In the implementations described herein, a number of example enclosures are described for housing electronic devices. In general, each enclosure may house one or more sub-devices, one or more modules, and/or any number of mechanical and electrical components to provide a functional portable computing device, for example, that integrates a speaker module (e.g., speaker housing) into a device housing of the portable computing device.

According to example implementations described throughout this disclosure, a non-conductive speaker module may include an integrated radio frequency transmissive window that couples to a conductive enclosure element to form a continuous edge of a device housing for a portable computing device. For example, the radio frequency transmissive window may be constructed of plastic with at least one wall of the window being affixed to the speaker module. The speaker module may then be integrally coupled to a metal enclosure to provide a continuous edge of the housing for the portable computing device.

In some implementations, the portable computing devices described herein may be a tablet type computing device, or the like. In some implementations, the portable computing devices described herein may be a laptop type computing device, or the like. In some implementations, the portable computing devices described herein may be a mobile phone type computing device, or the like. Other electronic devices are also possible.

FIG. 1A is a perspective view of a speaker module 100, according to an example implementation. The speaker module 100 may be integrated into a portable computing device, as described throughout this disclosure. Such portable computing devices may include a tablet computer or other type of computing device, such as, for example, a mobile phone, a laptop, a media player, a mobile device, or other handheld or portable electronic devices. Other configurations may be used for the computing device, if desired. The example of FIG. 1A is merely illustrative of a particular shape of speaker module that may be integrated into a computing device.

The speaker module 100 includes a first sidewall 102, a second sidewall 118, a first end wall 112, a second end wall 122, a front wall 116, and a rear wall 120. The first sidewall 102 is opposite and parallel to the second sidewall 118. The first end wall 112 is opposite and parallel to the second end wall 122. The first end wall 112 is coupled by a first edge and in a perpendicular fashion to a first edge of the first sidewall 102. The first end wall 112 is also coupled by a second edge and in a perpendicular fashion to a first edge of the second sidewall 118. Similarly, the second end wall 122 is coupled by a first edge and in a perpendicular fashion to a second edge of the first sidewall 102. The second end wall 122 is also coupled by a second edge and in a perpendicular fashion to a second edge of the second sidewall 118. The front wall 116 is opposite and parallel to the rear wall 120. The front wall 116 is coupled to the first sidewall 102 and the second sidewall 118 along respective edges of the entire length of each respective sidewall 102, 118. Similarly, the rear wall 120 is coupled to the first sidewall 102 and the second sidewall 118 along opposite respective edges of the entire length of each respective sidewall 102, 118.

As shown in FIG. 1A, the speaker module 100 includes a window portion 101 included on or as part of sidewall 102. For example, the window portion 101 may be the entire sidewall 102 or may be a portion of the sidewall 102. In some implementations, the window portion 101 of the sidewall 102 may include an edge 104 parallel to an edge 106. In some implementations, either or both edges 104 and 106 may be beveled. The edge 104 may be continuously formed to edge 106 by means of a center portion 108. Center portion 108 may be curved to couple edge 104 to edge 106. The edge 104, the center portion 108, and the edge 106 may be formed, affixed, or coupled to speaker housing (e.g., speaker module 100). In some implementations, the edge 104 and the edge 106 may be formed to couple to a housing for a portable electronic device (not shown) so as to form a continuous housing edge of the device.

The window portion 101 of the sidewall 102 may be constructed of a radio frequency transmissive window to allow radio frequency signals to be sent from devices (e.g., transceivers) within electronic device housing the speaker module 100 or received at one or more antennas) from other devices. For example, a flexible antenna cable 110 may receive radio frequency signals through window portion 101 of sidewall 102. In general, the window portion 101 of the sidewall 102 may be composed of plastic, glass, quartz, or a radio frequency transparent dielectric, just to name a few examples.

The flexible antenna cable 110 may be communicably coupled/connected to an end wall 112 of the speaker module 100. The flexible antenna cable 110 may be a mounting assembly for electrically coupling the antenna to a circuit board seated near or within speaker module 100. The mounting assembly (not shown) can include a radio frequency connector (not shown) for receiving an antenna and flexible antenna cable 110. The flexible antenna cable 110 may be used to flexibly mount the radio frequency connector to a housing of speaker module 100 (e.g., at end wall 112). The flexible antenna cable 110 may also be coupled to a printed circuit board (shown in FIG. to power the antenna and to detect initiated or received signals at the antenna. In operation, the radio frequency connector may be coupled to the antenna to receive radio signals at the printed circuit board. One or more antennas associated with flexible antenna cable 110 may be excited by radio signals to enable Wi-Fi, Bluetooth, cellular, or other wireless connections. In some implementations, the antenna may be used to perform payment transactions using radio frequency identification protocols. Such transactions can be carried out by transmitting signals through the window portion 101 of sidewall 102.

In some implementations, the speaker module 100 may also include a speaker aperture 114 on a front wall 116 to receive one or more speakers for emitting sound from the electronic device housing the speaker module 100. The speaker aperture 114 may be a through-hole opening that receives (e.g., is coupled to) at least one speaker (not shown). The speaker may be placed on an interior side of a sidewall 118 to align the output of the speaker with the aperture 114. Such an alignment enables sounds from the speaker to be directed outward from the electronic device housing the installed speaker module 100. A rear wall 120 (below end wall 112) may be configured to provide structural support for the installed speaker (not shown) and for a rear surface of an electronic device housing (not shown). An end wall 122 may complete the enclosure for speaker module 100.

Figure 1B:
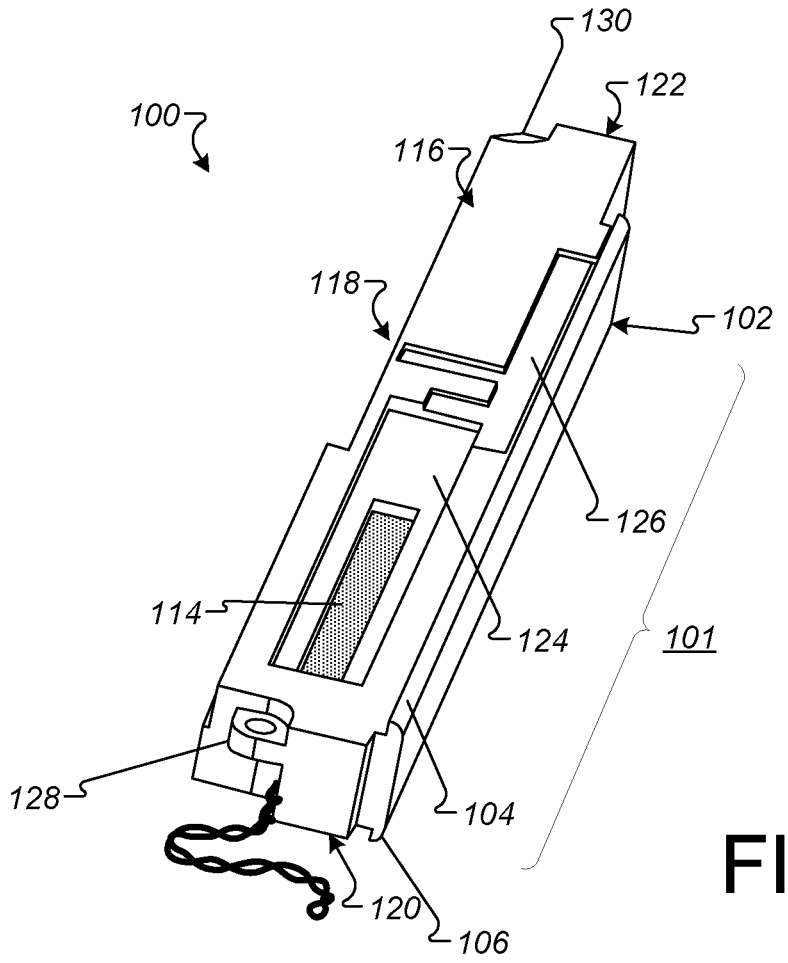
FIG. 1B is another example perspective view of an example speaker module, in accordance with implementations described herein.

FIG. 1B is another example perspective view of a speaker module 100, according to an example implementation. The example of FIG. 1B is merely illustrative of a particular shape of speaker module that may be integrated into a computing device. As shown, the speaker is installed in the aperture 114, similar to FIG. 1A. However, the example speaker module 100 includes additional recesses 124 and 126 to affix module 100 to a portable electronic device. In addition, the speaker module 100 includes additional structures 128 and 130 to affix the speaker module to a printed circuit board 146 (shown in FIG. 1C) and/or device enclosure of the computing device housing the speaker module 100, for example.

As shown in FIG. 1B, the speaker module 100 includes the first sidewall 102 opposite the second sidewall 118. The first sidewall 102 may be formed of a radio frequency transmissive window. The first sidewall 102 includes a first curved sidewall portion (e.g., edge 104) and a second curved sidewall portion (e.g., edge 106). The second curved sidewall portion (e.g., edge 106) may be aligned parallel to the first curved sidewall portion 104 to form the radio frequency transmissive window of sidewall 102. The first curved sidewall portion 104 may support a cover glass member 308 (shown in FIG. 3) of an electronic device housing. The second curved sidewall portion (e.g., edge 106) may support a conductive rear surface (e.g., rear wall 120) of the electronic device housing. The second sidewall 118 may include at least one port aperture 140 (shown in FIGS. 1C and 1E) to receive an electrical connection for at least one speaker that is mounted within speaker module 100.

The speaker module 100 also includes a first end wall 112 opposite a second end wall 122. The first end wall 112 may be configured to integrate a flexible antenna element (e.g., cable 110) for receiving radio frequency signals through the radio frequency transmissive window (e.g., window portion 101), for example. The speaker module 100 additionally includes the front wall 116 opposite the rear wall 120. The front wall 116 may include an aperture opening to receive the at least one speaker. The rear wall 120 may be configured to provide structural support for the bottom (e.g., rear) surface 232 (shown in FIG. 2B) of an electronic device housing. The first sidewall 102, the second sidewall 118, the first end wall 112, the second end wall 122, the front wall 116, and the rear wall 120 form an enclosure to house the at least one speaker (not shown).

Figure 1C:
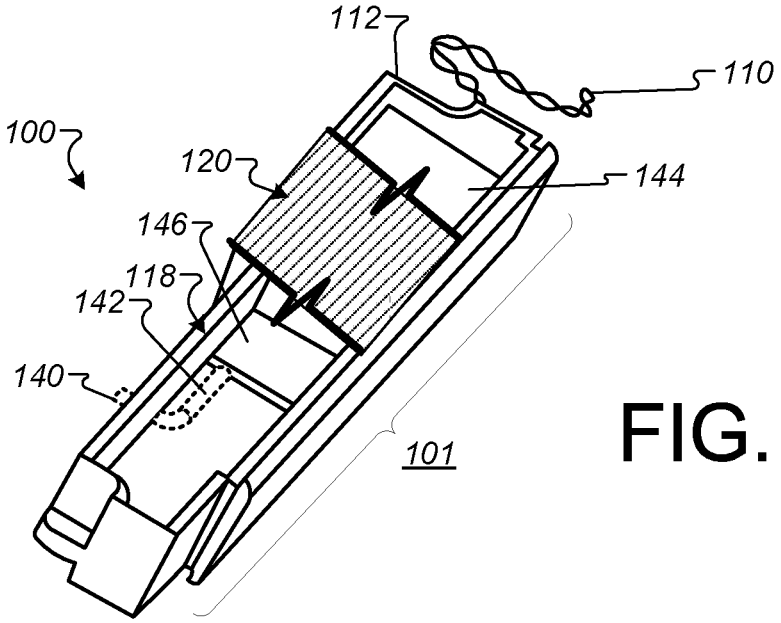
FIG. 1C is an example perspective view of a rear wall of an example speaker module, in accordance with implementations described herein.

FIG. 1C is an example perspective view of the rear wall 120 of the speaker module 100. The example of FIG. 1C is merely illustrative of a particular shape of speaker module that may be integrated into a computing device. As shown, the second sidewall 118 may include at least one port aperture 140 (shown in FIG. 1E) to receive an electrical and/or mechanical connection 142 for at least one speaker 144 that is mounted within speaker module 100. The connection 142 is shown communicably coupled to printed circuit board 146 to provide power and signal from speaker module 100 to antenna element (e.g., cable 110) and/or other devices and elements using speaker 144. In addition, the flexible antenna element is represented as flexible antenna cable 110 mounted to the speaker module 100 at an end wall 112.

Figure 1D:
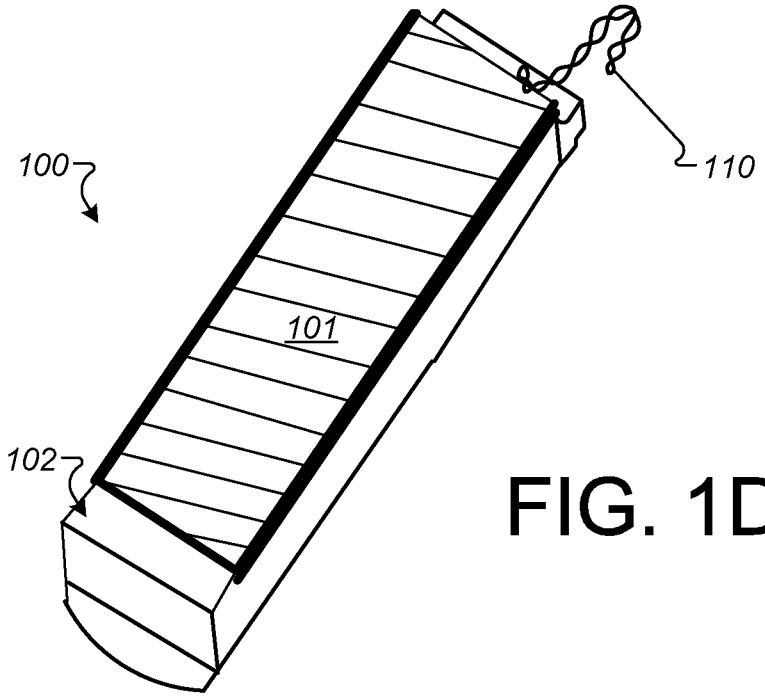
FIG. 1D is an example perspective view of a window portion of a sidewall of an example speaker module, in accordance with implementations described herein.

FIG. 1D is an example perspective view of the window portion 101 of the sidewall 102 of the speaker module 100. The example of FIG. 1D is merely illustrative of a particular shape of speaker module that may be integrated into a computing device. The speaker module 100 shown in FIG. 1D may provide at least one decorative edge for an electronic device housing (e.g., shown in FIG. 2A through FIG. 7). The speaker module 100 shown in FIG. 1D may provide one or more structural support members for the electronic device housing (e.g., shown in FIG. 2A through FIG. 7). The speaker module 100 shown in FIG. 1D may provide at least one structural support member for a display device seated in the electrical device housing (e.g., shown in FIG. 2A through FIG. 7). The speaker module 100 shown in FIG. 1D may provide at least one mounting member for the flexible antenna element (e.g., cable 110).

In general, window portion 101 is a radio frequency transmissive (e.g., radio-frequency-transparent) window. The window portion 101 may be affixed to (or formed of the same material as) the speaker module 100 (e.g., speaker housing) and integrally formed with a metal enclosure associated with a electronic device housing to form a continuous edge of the electronic device housing.

Figure 1E:
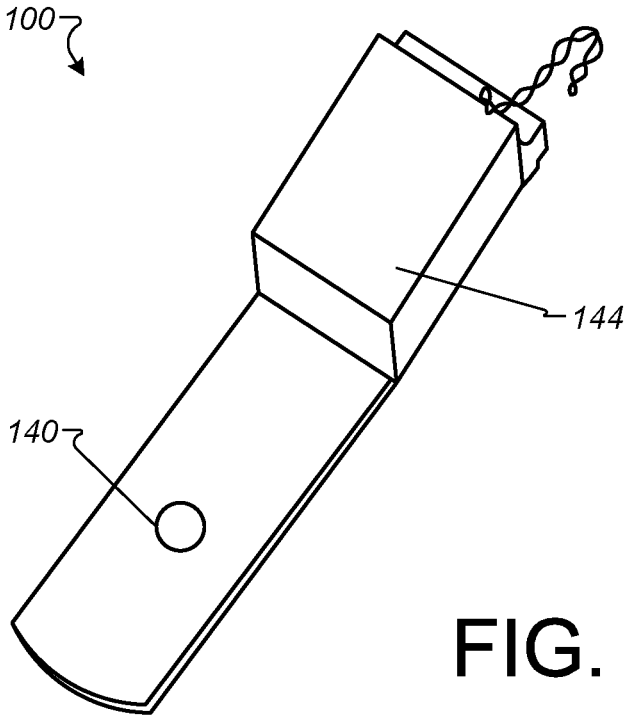
FIG. 1E is an example perspective view of a sidewall of an example speaker module, in accordance with implementations described herein.

FIG. 1E is an example perspective view of the sidewall 118 of the speaker module 100. The example of FIG. 1E is merely illustrative of a particular shape of speaker module that may be integrated into a computing device. Here, the port aperture 140 is depicted adjacent to speaker 144 and may receive mechanical and electrical connections to module 100, speaker 144, and/or printed circuit board 146 (shown in FIG. 1C). The connection to the printed circuit board 146 is not depicted in FIG. 1E, for clarity.

The speaker module 100 may be integrated into any of the computing devices described throughout this disclosure. Additional components and/or structure may be added or removed from speaker module 100 as long as the module retains the ability to be fitted into the computing devices to form a radio frequency transmissive portion of an enclosure of the respective computing devices disclosed herein.

Figure 2A:
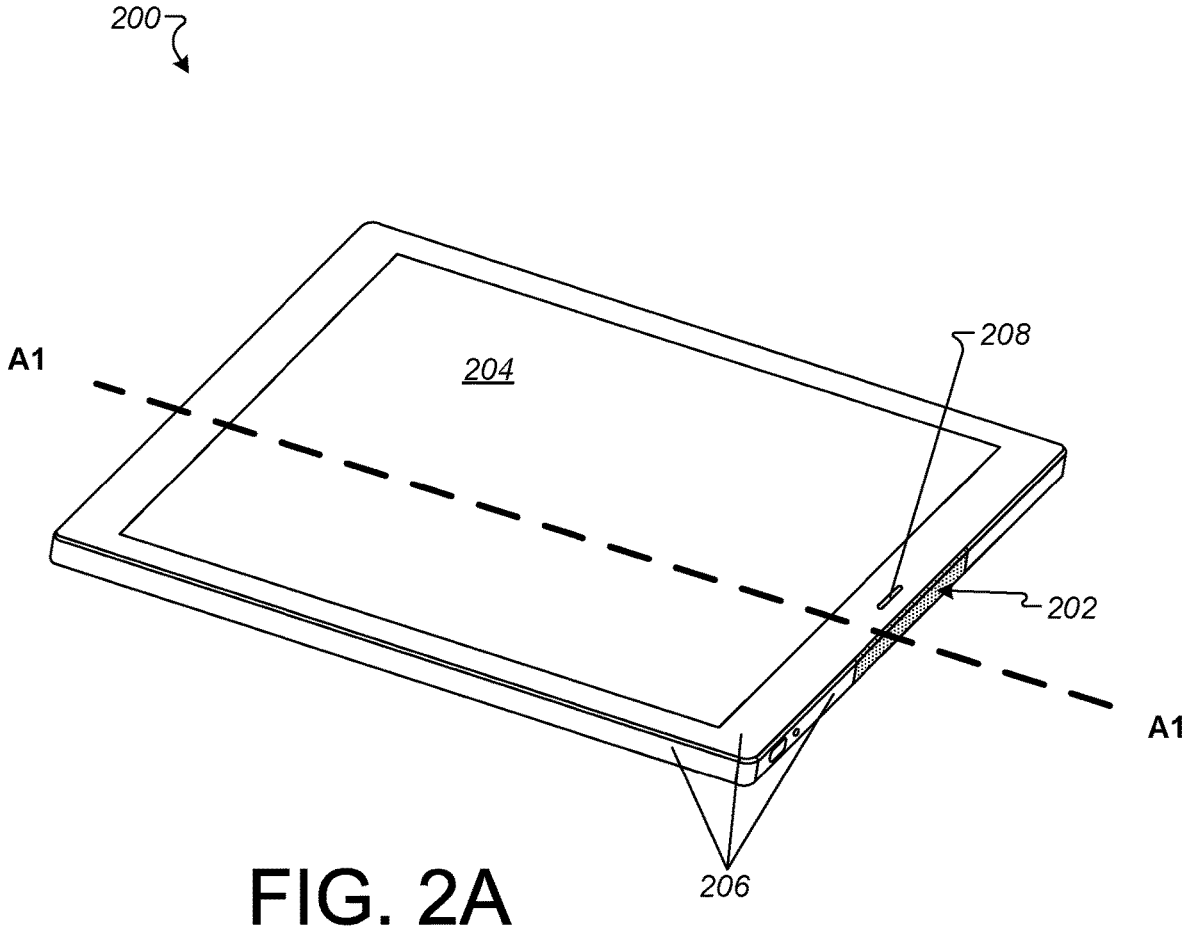
FIG. 2A is an example front perspective view of a portable computing device, in accordance with implementations described herein.

FIG. 2A is an example portable computing device 200 (e.g., portable electronic device) shown from a front perspective view and housing a speaker module 202, in accordance with implementations described herein. The portable computing device 200 is depicted as a tablet computer, however, device 200 may instead be a laptop computer or notebook computer, or other type of computing device, such as, for example, a cellular phone, a media player, a mobile device, or other handheld or portable electronic device. Other configurations may be used for the portable computing device 200 if desired. The example of FIG. 2A is merely illustrative.

The portable computing device 200 may include a display 310 (shown in FIG. 3) under cover glass 204. The display 310 may be on a front side of the device 200. The display 310 may present and/or display graphical output to a user through cover glass 204. In an example in which the display 310 is a touchscreen, the display 310 may also receive input from the user, such as tactile input when the user contacts the display 310 with one or more fingers.

The portable computing device 200 may include an enclosure 206 (e.g., housing or casing) that surrounds the device 200 to encase and protect device components. The speaker module 202 is shown integrated into enclosure 206. The portable computing device 200 also includes an aperture 208 for providing speaker sound for the device 200.

Figure 2B:
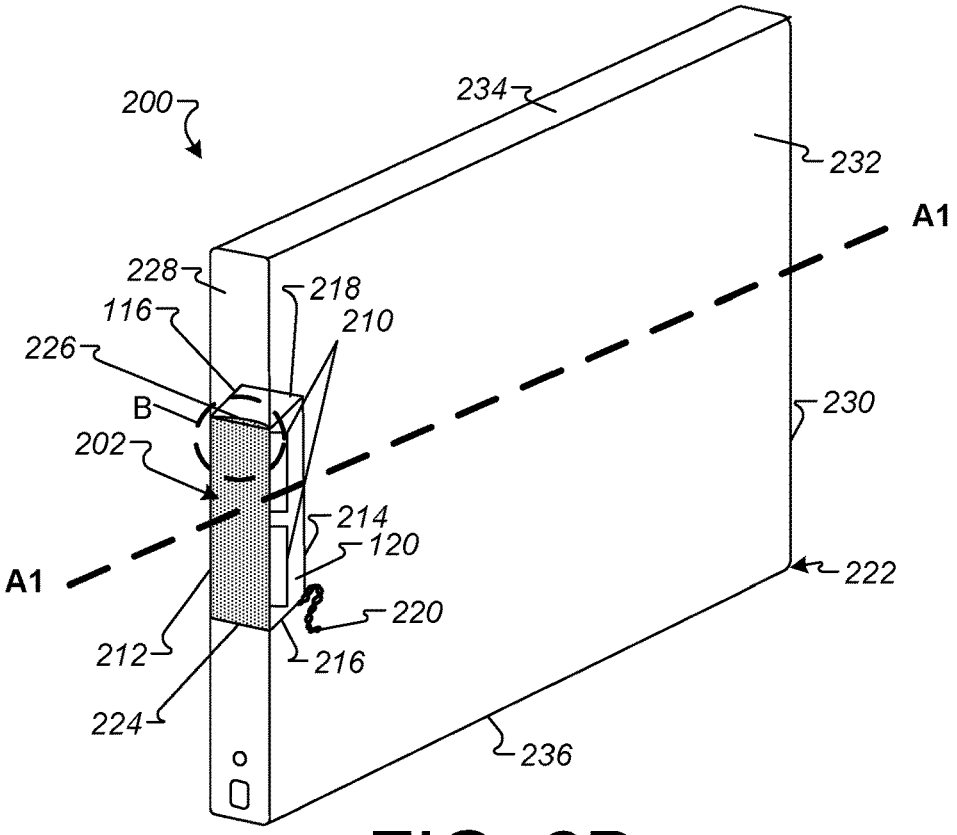
FIG. 2B is an example rear perspective view of a portable computing device, in accordance with implementations described herein.

FIG. 2B is an example of portable computing device 200 shown from a rear perspective view. The device is shown including the speaker module 202. In some implementations, the speaker module 202 may represent a first enclosure (e.g., encasing speaker module 202) that houses one or more speakers 210. The first enclosure encasing module 202 may include at least a first sidewall 212 opposite a second sidewall 214. The first sidewall 212 may form a curved radio-frequency-transparent element (e.g., window). The curve may include beveled or arched edges, beveled or arched center portions, and/or beveled or arched window element. The second sidewall 214 may include at least one port aperture (e.g., port aperture 140 in FIG. 1E) to receive an electrical connection.

The first enclosure (e.g., encasing module 202) may also include a first end wall 216 opposite a second end wall 218. The first end wall 216 may be configured to integrate a flexible antenna element 220 for receiving radio frequency signals through the curved radio-frequency-transparent element on sidewall 212. The first sidewall 212, the second sidewall 214, the first end wall 216, and the second end wall 218 may form the first enclosure (that encases speaker module 202) to house the at least one speaker 210.

The portable computing device 200 may also include or be associated with a second enclosure 222 configured to receive the first enclosure (e.g., speaker module 202). The second enclosure 222 may integrate the edges 224 and 226 of the first sidewall 212 (of the first enclosure 202) into a cavity formed by a beveled and/or curved edge of the second enclosure 222.

The second enclosure 222 (of device 200) includes a first sidewall 228 opposite a second sidewall 230. The second enclosure 222 also includes a top surface (not shown) and a bottom surface 232, as well as a third sidewall 234 and a fourth sidewall 236. The bottom surface 232 of device 200 extends in a direction along a longitudinal line A1-A1. The longitudinal line A1-A1 can be defined as extending in a direction along the first sidewall 228 of the enclosure 222 to the second sidewall 230 of the second enclosure 222 of device 200.

The speaker module 202 may provide at least one decorative edge of sidewall 212 for the portable electronic device 200, at least one structural support member (e.g., front wall 116 and rear wall 120 of module 202 similar to module 100) for the portable electronic device 200, at least one structural support member front wall 116 for the display 310 (shown in FIG. 3) seated in the portable electronic device 200, and at least one mounting member (e.g., end wall 216) for the flexible antenna element 220.

Figure 2C:
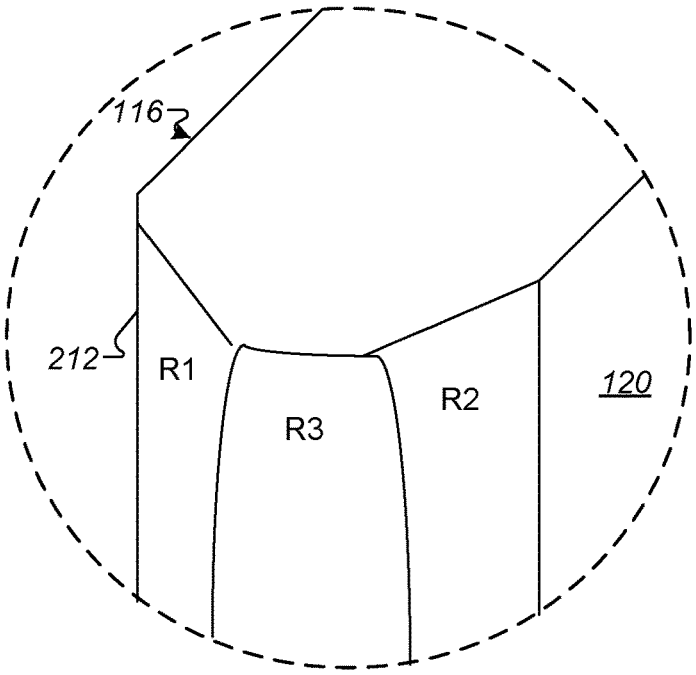
FIG. 2C is an enlarged view of an area associated with portion B shown in FIG. 2B, in accordance with implementations described herein.

FIG. 2C is an enlarged view of an area associated with portion B, shown in FIG. 2B. A portion of the module 202 is depicted, including a portion of front wall 116 and rear wall 120, and window forming all of sidewall 212. The window on the first sidewall 212 includes a first curved sidewall portion with a first radius of curvature R1, a second curved sidewall portion with a second radius of curvature R2. The second curved sidewall portion (e.g., at R2) may be aligned parallel to the first curved sidewall portion (e.g., at R1) to form the radio-frequency-transparent element (e.g., window on sidewall 212). The first curved sidewall portion may support a display cover glass of the portable electronic device 200 while the second curved sidewall portion may support a conductive rear surface (e.g., rear wall 120) of the portable electronic device 200. A center portion of the module 202 may be arched at a third radius of curvature R3 such that R3 provides a beveled edge to match a bevel in the second enclosure encasing the portable electronic device 200. In some implementations, radius of curvature R1 matches radius of curvature R2 to ensure a bevel provided by the radius of curvature R3. In some implementations, radius of curvature R1 is smaller than radius of curvature R2. In some implementations, radius of curvature R1 is larger than the radius of curvature R2. In some implementations, the radius of curvature R3 is a complement to the radius of curvature R2 and/or R1.

In some implementations, the rear surface (e.g., rear wall 120) is coupled to the first enclosure (e.g., encasing speaker module 202) and the second enclosure 222 to provide structural support for the display of the device 200 and support for both enclosures 202 and 222. In some implementations, the second enclosure is constructed of a conductive material (e.g., metal). In some implementations, the first enclosure (encasing speaker module 202) and the second enclosure 222 (encasing portable electronic device 200) are coupled to form at least one continuous decorative edge of the portable electronic device 200. For example, the second enclosure 222 may be formed of metal and the radio-frequency-transparent element (e.g., window in sidewall 212) is integrally formed with the second enclosure 222 to form a continuous edge of a housing of portable computing device 200.

In some implementations, the first enclosure 202 is constructed of a non-conductive material that allows radio frequency signals to be transmitted to the flexible antenna element 220. The flexible antenna element 220 may include at least one flexible cable mounted to the speaker module 202. The flexible antenna element 220 may be arranged to receive radio frequency signals through the radio-frequency-transparent window of sidewall 212, for example.

Figure 2D:
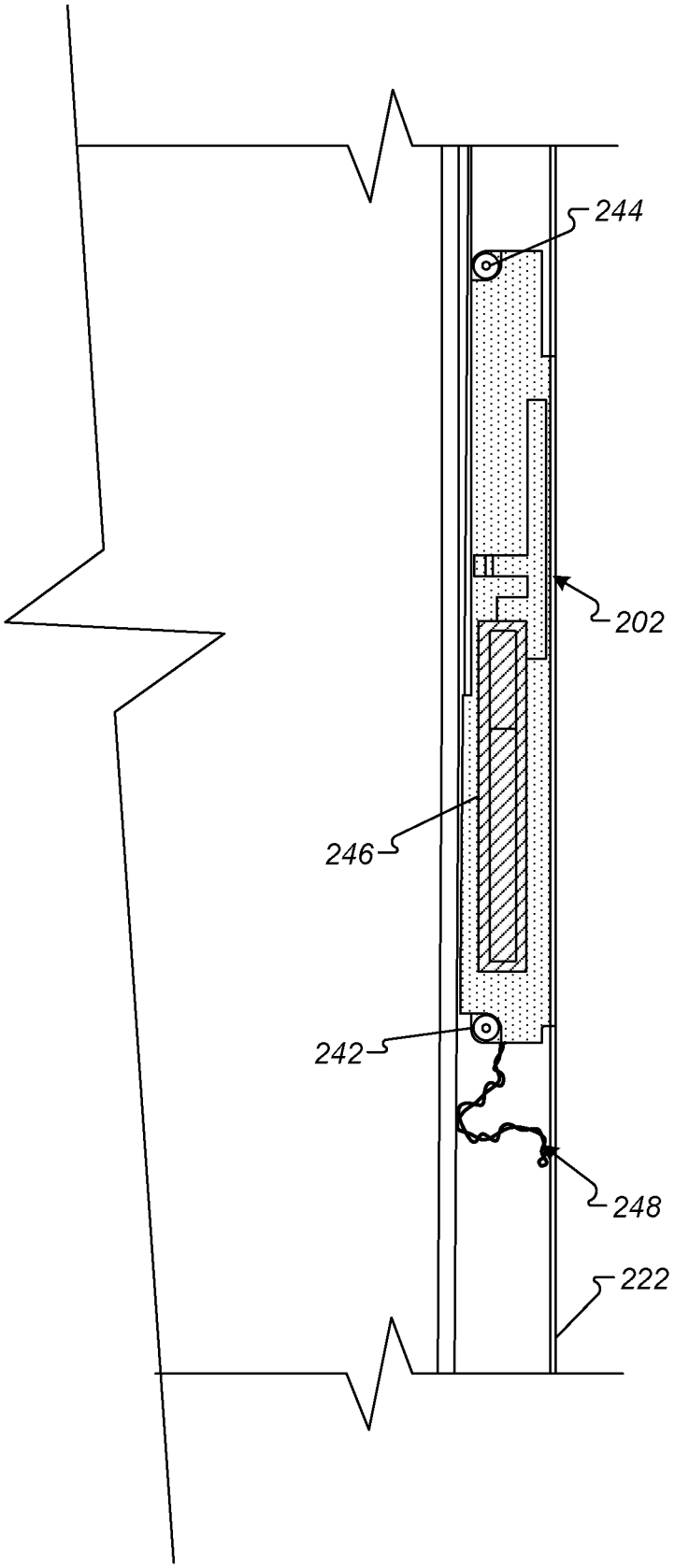
FIG. 2D is an example perspective view of a speaker module installed in a portable electronic device housing, in accordance with implementations described herein.

FIG. 2D is another example perspective view of the speaker module 202 installed in a portable electronic device housing/enclosure 222, according to an example implementation. The example of FIG. 2D is merely illustrative of a particular shape of speaker module that may be integrated into a computing device. The elements shown in FIG. 2D may be seated within an enclosure for a computing device including, but not limited to, a laptop, a notebook, a mobile device, a tablet device, or the like.

As shown, the speaker is installed in the aperture of housing/enclosure 222. In this example, the speaker module 202 includes structures 242 and 244 to affix the speaker module to a printed circuit board (not shown) and/or to the housing/enclosure 222.

The speaker module 202 is shown from a top down view. A display and display glass may be seated to cover the depicted view of the device housing module 202 shown in FIG. 2D. Speakers may be mounted within module 202 to provide sound via cavity 246. The antenna cable 248 may be used to receive radio frequency signals through the window in speaker module 202.

Figure 3:
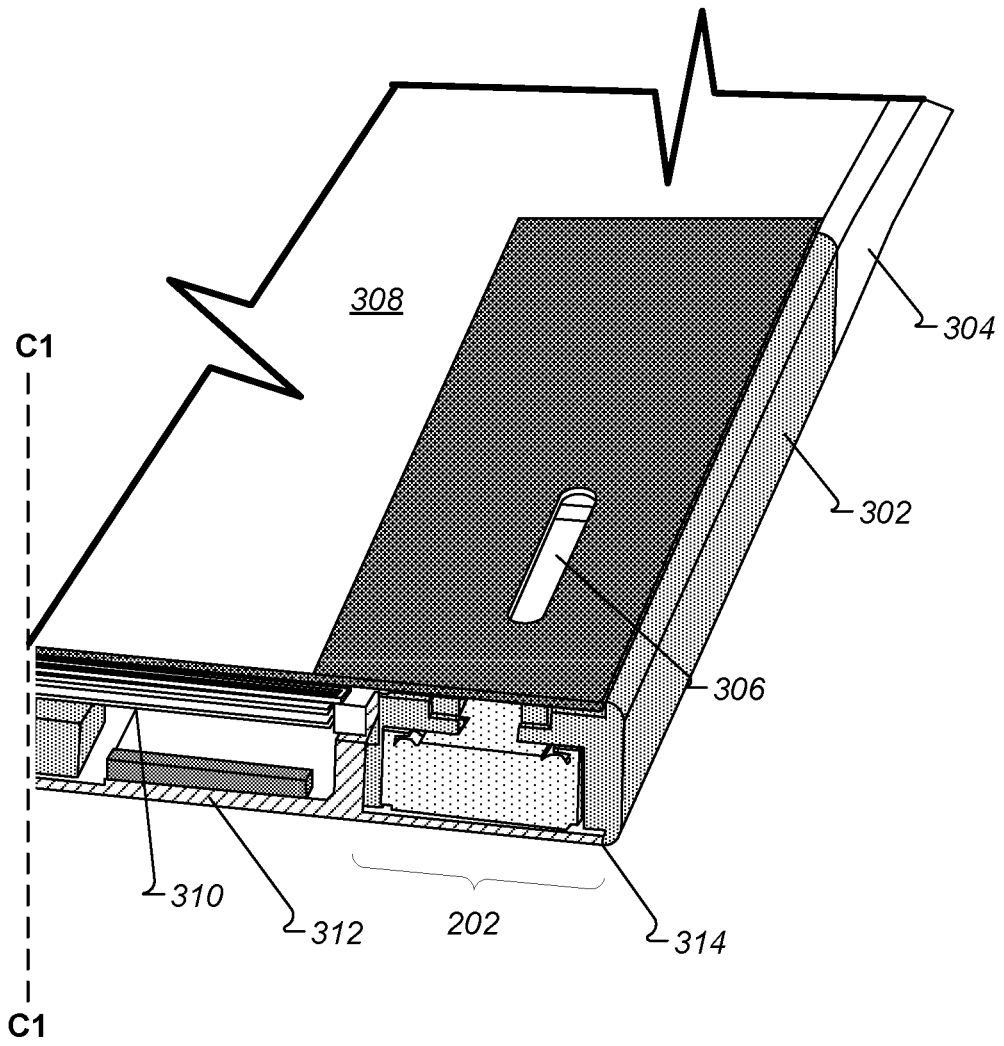
FIG. 3 is a view of an example cutaway view of the portable computing device of FIG. 2A.

FIG. 3 is a cutaway view of portable computing device 200 cut along a line C1-C1 to expose internal components of device 200 along the longitudinal line A1-A1 (FIG. 2B). Here, a portion of the speaker module 202 (e.g., a first enclosure) is shown. For example, the radio frequency transmissive window 302 is shown installed in an enclosure 304 for the portable computing device 200 (e.g., similar to the second enclosure 222).

In some implementations, the first enclosure (e.g., speaker module 202) includes at least one cavity housing a speaker configured to amplify sound signals for the portable electronic device 200. For example, the cavity may be adapted to fixedly insert the speaker module into the second enclosure 304 such that one or more speakers align with a cavity 306 in a cover glass member 308. The cover glass member 308 is protecting display 310 while display 310 emits pixels through member 308.

A rear panel 312 is shown coupled into window 302 at point 314. The rear panel 312 may be supported by both window 302 and a rear wall of speaker module 202. In some implementations, the enclosure 304 may be formed of metal and the window 302 (e.g., the radio-frequency-transparent element) may be integrally formed with the enclosure 304 to form a continuous edge of the portable computing device. In some implementations, the window 302 is formed of the same non-conductive material as the speaker module 202 and may be fitted into a cavity within the enclosure 304.

Figure 4A:
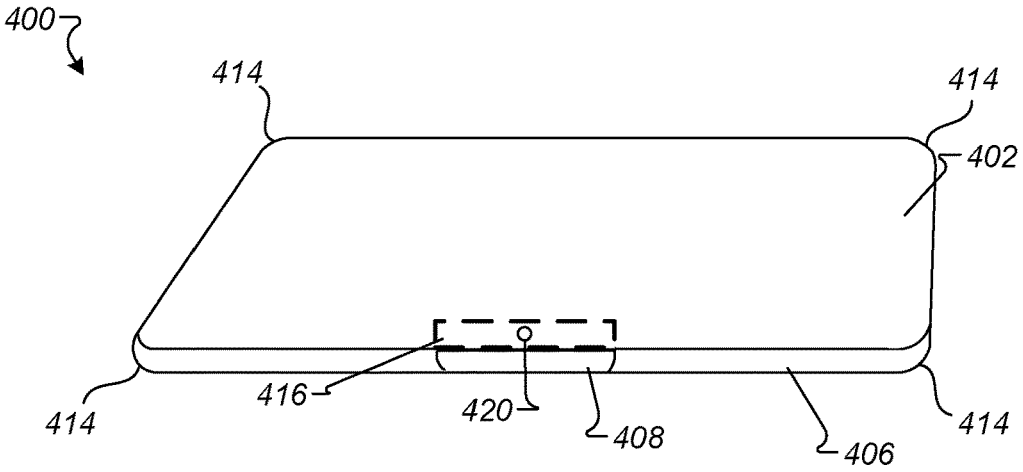
FIG. 4A is a closed configuration for an example portable computing device housing a speaker module, in accordance with implementations described herein.
Figure 4B:
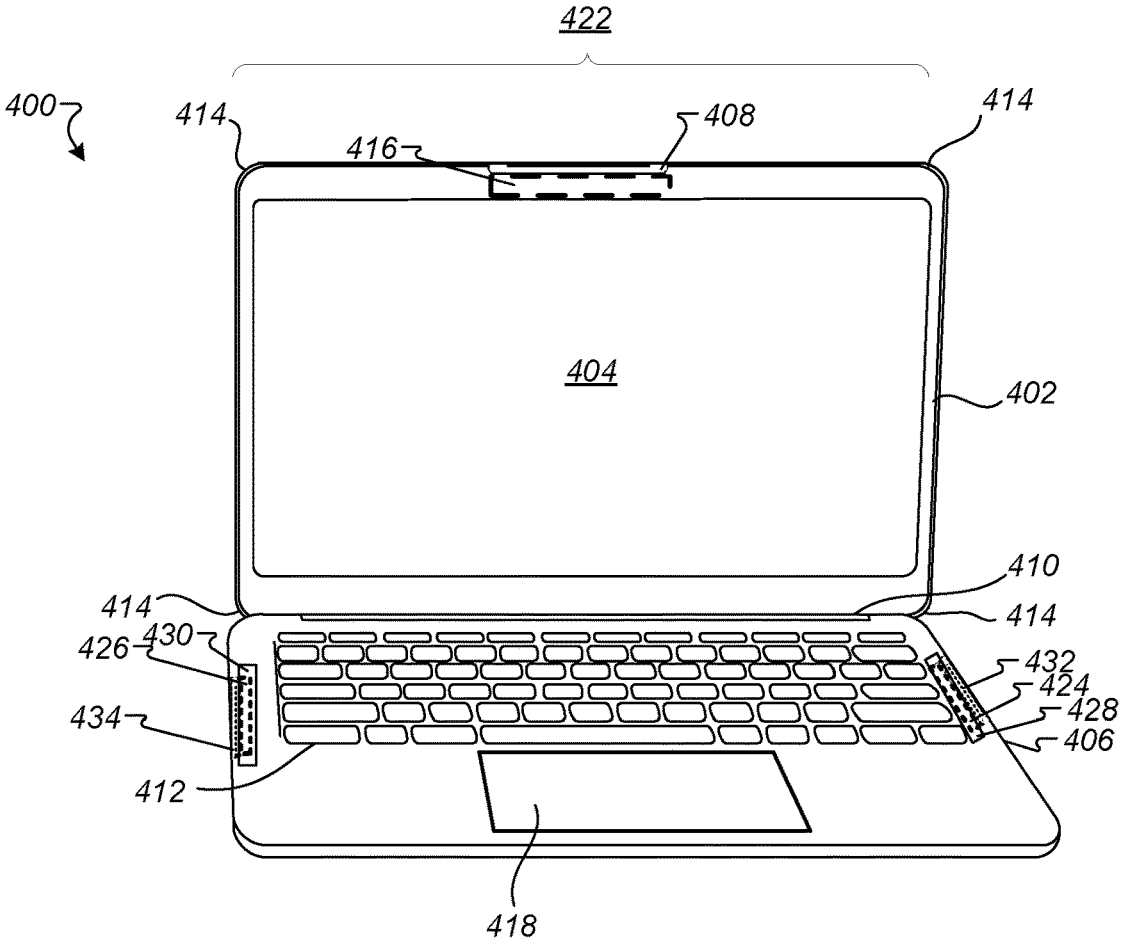
FIG. 4B is an open configuration for an example portable computing device housing a speaker module, in accordance with implementations described herein.

FIGS. 4A and 4B are perspective views of an example portable computing device housing an example speaker module in accordance with implementations described herein. FIG. 4A is a perspective view of the computing device 400 in a closed position. FIG. 4B is a perspective view of the computing device 400 in an open position. In some implementations, the portable computing device 400 may include a display portion including a display portion and a base portion including a keyboard, in which the base portion is attached to the display portion.

The portable computing device 400 may include a laptop computer or notebook computer that includes an enclosure (e.g., housing) that encases the device and provides a window that is radio frequency transmissive so that the device 400 may receive signals at an interior mounted antenna (e.g., antenna cable 248 shown in FIG. 2D) and send signals via an interior mounted transceiver (not shown). The example of FIG. 4A is merely illustrative.

As shown in FIG. 4A, the portable computing device 400 may include a display portion 402. The display portion 402 may include a display 404 (labeled in FIG. 4B) on a front side of the display portion 402. The display 404 may present and/or display graphical output to a user. In an example in which the display 404 is a touchscreen, the display 404 may also receive input from the user, such as tactile input when the user contacts the display 404 with one or more fingers.

The portable computing device 400 may include a base portion 406. In some implementations, a surface, particular, an outer surface, of the display portion 402 and the base portion 406 may be composed of conductive materials. A radio frequency transmissive window 408 may be installed in a cavity of the display portion 402. The window 408 may be composed of a non-conductive material such that radio frequency signals may pass through the window 408.

The base portion 406 may be rotatably attached to the display portion 402, and/or the display portion 402 may be rotatably attached to the base portion 406 via a hinge 410, for example. The rotatable attachment of the display portion 402 to the base portion 406 may enable the display portion 402 to rotate from an open position to a closed position, as shown in FIGS. 4A and 4B, in which the display portion 402 may contact the base portion 406, closing an exposure of a physical keyboard 412 disposed on the base portion 406, as shown in FIG. 4B. Similarly, a trackpad 418 may be provided on base portion 406.

The display portion 402 may include a housing 414 that encloses the entire display portion 402. For example, the housing 414 may enclose components of the portable computing device 400, such as a speaker module 416, processor, memory, bus, and other components described in greater detail with respect to FIG. 6.

The housing 414 may include a cavity 420 in a top side of the display portion 402 to allow sound to be emitted from the speaker module 416. The speaker module 416 may be affixed to the window 408 as an assembly and fitted behind the cavity 420 during manufacturing of the portable computing device 400, for example. The assembly may be fit within display portion 402 to provide a continuous housing 414 to generate a sleek continuous perimeter of the housing 414.

FIG. 4B is a perspective view of the portable computing device 400 in the open position, according to an example implementation. As shown in FIG. 4B, the display portion 402 may be rotated away from the base portion 406 at a user-selected angle. The display portion 402 may include a front side that includes the display 404 and a back side (not shown) that is opposite from the front side. When the portable computing device 400 is used in the open position, the bottom side of the base portion 406 may rest on a flat surface, such as a surface of a table or desk.

In some implementations, the computing device 400 may be generally rectangular shaped having two long sides (e.g., a front side and a back side) and two short sides (e.g., a right side and a left side). The computing device 400 can be other shapes, such as, for example, a square. Further, as shown in at least FIG. 4B, the corners of housing 414 can be curved (e.g., rounded, smooth, etc.) so as to protect the computing device 400 from damage due to impact when compared to a sharp edge corner. Further, the curved corners of housing 414 can provide an aesthetically pleasing look and/or feel to the computing device 400. In some implementations, the corners 414 of the computing device 400 can have a chamfered or beveled edge.

In this example, the radio frequency transmissive window 408 is shown in the display portion 402. The window 408 may continue to allow radio frequency signals to pass through in the open and/or closed position. In some implementations, the window 408 may be integrated with the speaker module 416. The speaker module may be installed between the display 404 and the display portion 402. The window 408 may be configured to cover at least one sidewall of the speaker module 416.

The curved corners of housing 414 may be continued along an edge 422 of the computing device 400 and may flow from both top corners into the window 408 to form a decorative and continuous edge for device 400 when speaker module 416 is installed. The window 408 may be crafted such that a switch of materials may be seen along the edge 422 between the window 408 and the enclosure running along corners 414 (as well as edges connecting such corners), but the aesthetic of the enclosure for the device 400 remains a smooth and continuous edge.

In some implementations, the base portion 406 may include a housing (e.g., enclosure, casing, etc.) to house at least one speaker module 424 (and/or speaker module 426) inside of the base portion 406. The speaker(s) may be located on one or both sides of the base portion 406. As shown in FIG. 4B, the housing may further include speaker openings 428 and 430 (e.g., holes, cutouts, grill, etc.) on a surface thereof. The speaker openings 428 and 430 may correspond to a location of the speaker modules 424 and/or 426 disposed inside of the base portion 406 to allow sound to be delivered to the ambiance from the speaker disposed within the housing. If one or both speaker modules 424 and 426 are installed, at least one radio frequency transmissive window 432 or 434 may be installed on a side edge of base portion 406 to allow for signal movement through the windows 432 and/or 434.

In some implementations, if windows 432 or 434 are installed in device 400, window 408 and speaker module 416 may not be installed in device 400. Similarly, a speaker module and window 408 may not be installed in device 400 if speaker modules 424 or 426 are instead installed in device 400.

In some implementations, the enclosure housing computing device 400 may provide structural support for various internal components (including integrated circuit chips and other circuitry, displays, etc.) to provide computing operations for the computing device 400. Although not shown in this figure, the enclosure around device 400 may define a cavity within which the components may be positioned and such an enclosure may also physically support any suitable number of mechanisms, within device 400 or within openings through the surface of device 400.

Figure 5:
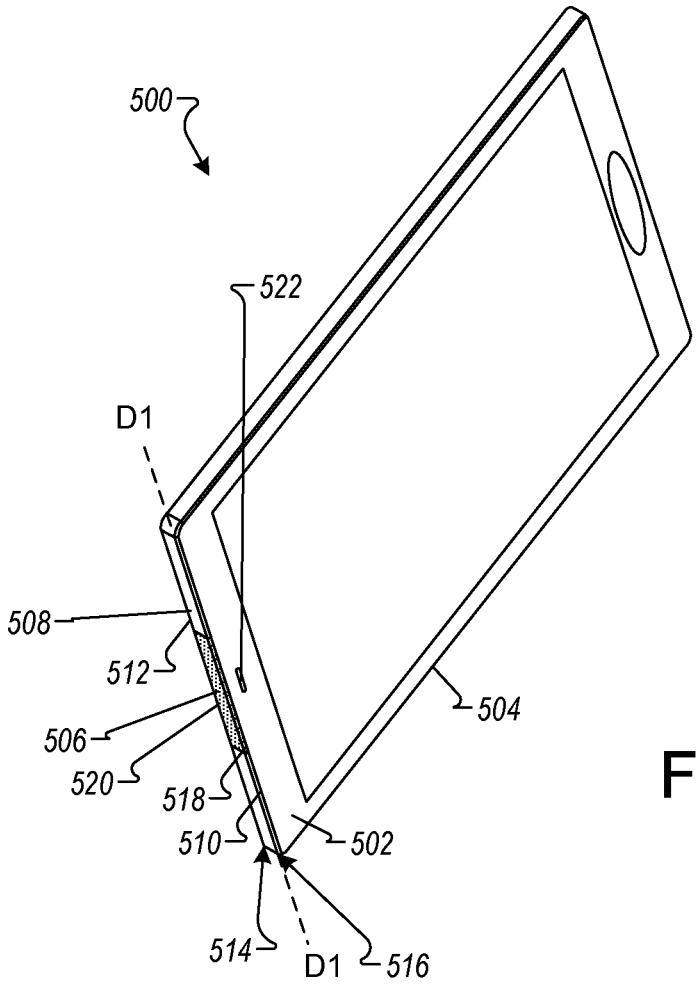
FIG. 5 is a perspective view of an example portable computing device housing an example speaker module in accordance with implementations described herein.

FIG. 5 is a perspective view of an example portable computing device housing 500 an example speaker module in accordance with implementations described herein. The device within housing 500 may be a mobile computing device. The housing 500 may include a first cover portion 502 (e.g., an upper cover portion) and a second cover portion 504 (e.g., a lower cover portion). The first cover portion 502 may include a cover glass protecting an installed display (not shown) of the portable computing device.

The first cover portion 502 can be defined as a structural component of the housing 500 and may be configured for protecting the portable computing device installed within housing 500. The first cover portion 502 can include a casing or enclosure (e.g., upper shell housing) configured for protecting the subsystem and components positioned within the computing device installed in the housing 500.

The second cover portion 504 may include a casing or enclosure (e.g., lower shell housing) for protecting the subsystem and components positioned within the portable computing device installed within housing 500. The second cover portion 504 may be a structural component of housing 500 and may be configured for protecting the portable computing device installed within housing 500.

In addition to providing protection, the second cover portion 504 include a radio frequency transmissive window 506 on an edge 508 of the second cover portion 504. The radio frequency transmissive window 506 may be coupled to (e.g., integrated into, affixed to, irremovably attached to, etc.) a speaker module (not shown) housed in the enclosure to form a portion of the edge 508 of the enclosure (e.g., housing 500).

In some implementations, the radio frequency transmissive window 506 extends in a direction along a longitudinal line (D1-D1) along the portion (shown as window 506) of the edge 508 of the enclosure (e.g., housing 500). In some implementations, the radio frequency transmissive window 506 is aligned to house a flexible antenna element (e.g., element 220 in FIG. 2B) arranged to receive radio frequency signals through the radio frequency transmissive window 506.

In some implementations, the first cover portion 502 includes a first curved sidewall portion 510. The enclosure (e.g., housing 500) may also include the second cover portion 504 that includes a second curved sidewall portion 512 on the lower shell housing, for example. The second curved sidewall portion 512 may be aligned with the first curved sidewall portion 510 to form a continuous sidewall edge 508 for the housing 500.

The second cover portion 504 may include the radio frequency transmissive window 506 on an edge of the second cover portion 504, as shown by curved bevels 514 and 516 running the length of sidewall 508 parallel to longitudinal line (D1-D1). The radio frequency transmissive window 506 is also formed of first and second curved bevels 518 and 520 to ensure a smooth transition from housing 500 to window 506 and back to housing 500 on both the first cover portion 502 and the second cover portion 504.

The radio frequency transmissive window 506 may be coupled to a speaker module housed in the housing 500 to form the additional portion of the edges running along the length of the device along line (D1-D1) to form rounded bevels 514 and 516 of the enclosure.

In some implementations, the first curved sidewall portion 510 has a first radius of curvature, the second curved sidewall portion 512 has a second radius of curvature, and the radio frequency transmissive window 506 has a third radius of curvature to complement the first radius of curvature and the second radius of curvature to form the continuous sidewall portion. For example, the first radius of curvature (R1 in FIG. 2C) may represent a first beveled edge of housing 500. Similarly, the second radius of curvature (R2 in FIG. 2C) may represent a second beveled edge of housing 500. The third radius of curvature (R3 in FIG. 2C) may represent a center portion of housing 500. R1 may run the length of the device along line (D1-D1) to form rounded bevel 514 while R2 may run the length of the device along line (D1-D1) to form rounded bevel 516. Both radii of curvatures may arch into center portion of edge 508 that is formed at R3 radius of curvature along (D1-D1) to form a smooth and continuous edge for housing 500. In some implementations, the second radius of curvature is the same as the first radius of curvature to form a symmetrical edge housing. In some implementations, the first radius of curvature may be smaller or larger than the second radius of curvature to form device enclosures that are asymmetrical on surfaces and/or edges.

In some implementations, the enclosure (e.g., housing 500) is composed of conductive material (e.g., metal) and the radio frequency transmissive window 506 is composed of non-conductive material (e.g., plastic) and the radio frequency transmissive window 506 is integrally formed on a sidewall edge 508 of a speaker module (e.g., element 220 in FIG. 2B) of the portable computing device (e.g., device 200). In addition, the window 506 may be configured to form a continuous edge of the enclosure (e.g., housing 500) when the speaker module is installed into the portable computing device (e.g., device 200) installed in housing 500.

For example, the first cover portion 502 and the second cover portion 504 may be formed with a metal material, such as, for example, magnesium. Other metal materials may be employed. In some implementations, other non-metal materials or some other material, such as various composite polymers, may be used for protecting the subsystem and components positioned within housing 500. In some implementations, the first cover portion 502 and the second cover portion 504 may be formed with different materials.

As shown in FIG. 5, the speaker module that includes window 506 may be installed behind portion 502. The speaker module may provide sound through cavity 522. In general, at least one edge of the portable computing devices described herein may include a speaker module with an integrated radio frequency transmissive window that allows sending and receiving of radio frequency signals through the window. Such a window may allow the passage of radio frequency signals to and from the device while providing a seamless and decorative edge for the device. At least one of the surfaces of the exemplary speaker modules described herein may provide structural integrity for supporting a display and/or display glass of the computing devices described throughout this disclosure.

In general, the portable computing devices (e.g., portable electronic devices) described herein includes at least one processor configured to access memory, at least one communications interface, at least one transceiver configured to send and receive wireless signals, at least one flexible antenna element, a display, and a speaker mounted in a speaker module. Each portable electronic device also includes a first enclosure housing the speaker module, the enclosure including, a first sidewall opposite a second sidewall, the first sidewall forming a curved radio-frequency-transparent element and the second sidewall including at least one port aperture to receive an electrical connection. The enclosure also includes a first end wall opposite a second end wall, the first end wall configured to integrate the flexible antenna element for receiving radio frequency signals through the curved radio-frequency-transparent element, wherein the first sidewall, the second sidewall, the first end wall, and the second end wall form the first enclosure to house the at least one speaker. Each portable electronic device also includes a second enclosure configured to receive the first enclosure, the second enclosure integrating the first sidewall of the first enclosure into a cavity formed by a beveled edge of the second enclosure.

Figure 6:
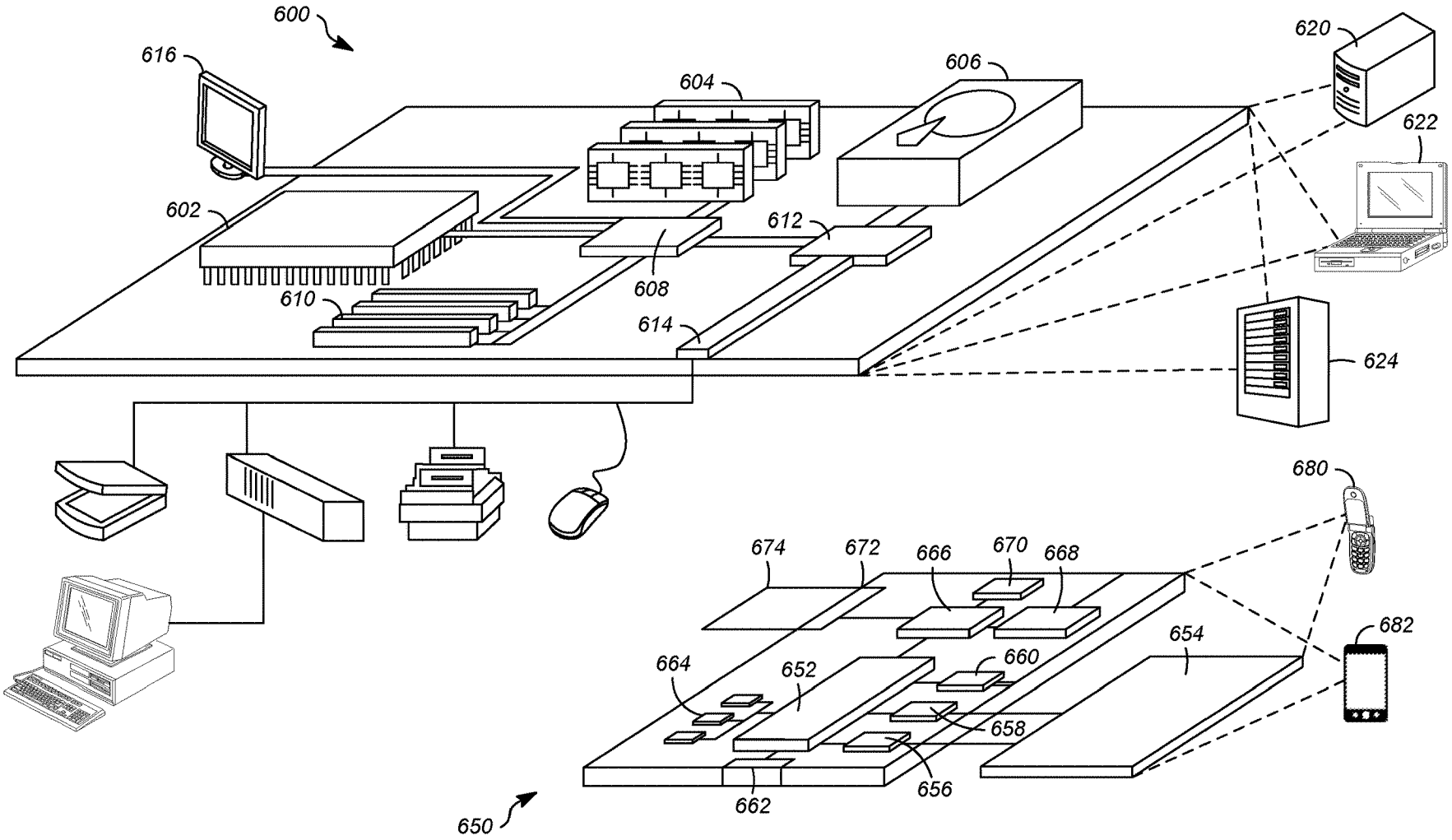
FIG. 6 illustrates an example of a computer device and a mobile computer device that can be used with the implementations described here.

FIG. 6 shows an example of an example computer device 600 and an example mobile computer device 650, which may be used with the techniques described here. Features described with respect to the computer device 600 and/or mobile computer device 650 may be included in the portable computing device 100 described above. Computing device 600 is intended to represent various forms of digital computers, such as laptops, desktops, workstations, personal digital assistants, servers, blade servers, mainframes, and other appropriate computers. Computing device 650 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 600 includes a processor 602, memory 604, a storage device 606, a high-speed interface 608 connecting to memory 604 and high-speed expansion ports 610, and a low speed interface 612 connecting to low speed bus 614 and storage device 606. Each of the components 602, 604, 606, 608, 610, and 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high speed interface 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor sy stem).

The memory 604 stores information within the computing device 600. In one implementation, the memory 604 is a volatile memory unit or units. In another implementation, the memory 604 is a non-volatile memory unit or units. The memory 604 may also be another form of computer-readable medium, such as a magnetic or optical disk.

The storage device 606 is capable of providing mass storage for the computing device 600. In one implementation, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 604, the storage device 606, or memory on processor 602.

The high speed controller 608 manages bandwidth-intensive operations for the computing device 600, while the low speed controller 612 manages lower bandwidth-intensive operations. Such allocation of functions is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 606 and low-speed expansion port 614. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 650. Each of such devices may contain one or more of computing device 600, 650, and an entire system may be made up of multiple computing devices 600, 650 communicating with each other.

Computing device 650 includes a processor 652, memory 664, an input/output device such as a display 654, a communication interface 666, and a transceiver 668, among other components. The device 650 may also be provided with a storage device, such as a microdrive or other device, to provide additional storage. Each of the components 650, 652, 664, 654, 666, and 668, are interconnected using various buses, and several of the components may be mounted on a common motherboard or in other manners as appropriate.

The processor 652 can execute instructions within the computing device 650, including instructions stored in the memory 664. The processor may be implemented as a chipset of chips that include separate and multiple analog and digital processors. The processor may provide, for example, for coordination of the other components of the device 650, such as control of user interfaces, applications run by device 650, and wireless communication by device 650.

Processor 652 may communicate with a user through control interface 658 and display interface 656 coupled to a display 654. The display 654 may be, for example, a TFT LCD (Thin-Film-Transistor Liquid Crystal Display) or an OLED (Organic Light Emitting Diode) display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may be provide in communication with processor 652, so as to enable near area communication of device 650 with other devices. External interface 662 may provide, for example, for wired communication in some implementations, or for wireless communication in other implementations, and multiple interfaces may also be used.

The memory 664 stores information within the computing device 650. The memory 664 can be implemented as one or more of a computer-readable medium or media, a volatile memory unit or units, or a non-volatile memory unit or units. Expansion memory 674 may also be provided and connected to device 650 through expansion interface 672, which may include, for example, a SIMM (Single In Line Memory Module) card interface. Such expansion memory 674 may provide extra storage space for device 650, or may also store applications or other information for device 650. Specifically, expansion memory 674 may include instructions to carry out or supplement the processes described above, and may include secure information also. Thus, for example, expansion memory 674 may be provide as a security module for device 650, and may be programmed with instructions that permit secure use of device 650. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 674, or memory on processor 652, that may be received, for example, over transceiver 668 or external interface 662.

Device 650 may communicate wirelessly through communication interface 666, which may include digital signal processing circuitry where necessary. Communication interface 666 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, WiFi, or other such transceiver (not shown). In addition, GPS (Global Positioning System) receiver module 670 may provide additional navigation- and location-related wireless data to device 650, which may be used as appropriate by applications running on device 650.

Device 650 may also communicate audibly using audio codec 660, which may receive spoken information from a user and convert it to usable digital information. Audio codec 660 may likewise generate audible sound for a user, such as through a speaker, e.g., in a handset of device 650. Such sound may include sound from voice telephone calls, may include recorded sound (e.g., voice messages, music files, etc.) and may also include sound generated by applications operating on device 650.

The computing device 650 may be implemented in a number of different forms, as shown in the figure. For example, it may be implemented as a cellular telephone 680. It may also be implemented as part of a smart phone 682, personal digital assistant, or other similar mobile device.

Implementations of the various techniques described herein may be implemented in digital electronic circuitry, or in computer hardware, firmware, software, or in combinations of them. Implementations may implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program, such as the computer program(s) described above, can be written in any form of programming language, including compiled or interpreted languages, and can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps may be performed by one or more programmable processors executing a computer program to perform functions by operating on input data and generating output. Method steps also may be performed by, and an apparatus may be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

To provide for interaction with a user, implementations may be implemented on a computer having a display device, e.g., a cathode ray tube (CRT) or liquid crystal display (LCD) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Implementations may be implemented in a computing system that includes a back-end component, e.g., as a data server, or that includes a middleware component, e.g., an application server, or that includes a front-end component, e.g., a client computer having a graphical user interface or a Web browser through which a user can interact with an implementation, or any combination of such back-end, middleware, or front-end components. Components may be interconnected by any form or medium of digital data communication, e.g., a communication network. Examples of communication networks include a local area network (LAN) and a wide area network (WAN), e.g., the Internet.

The computing device according to example embodiments described herein may be implemented using any appropriate combination of hardware and/or software configured for interfacing with a user including a user device, a user interface (UI) device, a user terminal, a client device, or a customer device. The computing device may be implemented as a portable computing device, such as, for example, a laptop computer. The computing device may be implemented as some other type of portable computing device adapted for interfacing with a user, such as, for example, a PDA, a notebook computer, or a tablet computer. The computing device may be implemented as some other type of computing device adapted for interfacing with a user, such as, for example, a PC. The computing device may be implemented as a portable communication device (e.g., a mobile phone, a smart phone, a wireless cellular phone, etc.) adapted for interfacing with a user and for wireless communication over a network including a mobile communications network.

The computer system (e.g., computing device) may be configured to wirelessly communicate with a network server over a network via a communication link established with the network server using any known wireless communications technologies and protocols including radio frequency (RF), microwave frequency (MWF), and/or infrared frequency (IRF) wireless communications technologies and protocols adapted for communication over the network.

In accordance with aspects of the disclosure, implementations of various techniques described herein may be implemented in digital electronic circuitry, or in computer hardware, firmware, software, or in combinations of them. Implementations may be implemented as a computer program product (e.g., a computer program tangibly embodied in an information carrier, a machine-readable storage device, a computer-readable medium, a tangible computer-readable medium), for processing by, or to control the operation of, data processing apparatus (e.g., a programmable processor, a computer, or multiple computers). In some implementations, a tangible computer-readable storage medium may be configured to store instructions that when executed cause a processor to perform a process. A computer program, such as the computer program(s) described above, may be written in any form of programming language, including compiled or interpreted languages, and may be deployed in any form, including as a stand-alone program or as a module, component, subroutine, or other unit suitable for use in a computing environment. A computer program may be deployed to be processed on one computer or on multiple computers at one site or distributed across multiple sites and interconnected by a communication network.

Specific structural and functional details disclosed herein are merely representative for purposes of describing example embodiments. Example embodiments, however, may be embodied in many alternate forms and should not be construed as limited to only the embodiments set forth herein.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of the stated features, steps, operations, elements, and/or components, but do not preclude the presence or addition of one or more other features, steps, operations, elements, components, and/or groups thereof.

It will be understood that when an element is referred to as being "coupled," "connected," or "responsive" to, or "on," another element, it can be directly coupled, connected, or responsive to, or on, the other element, or intervening elements may also be present. In contrast, when an element is referred to as being "directly coupled," "directly connected," or "directly responsive" to, or "directly on," another element, there are no intervening elements present. As used herein the term "and/or" includes any and all combinations of one or more of the associated listed items.

Spatially relative terms, such as "beneath," "below," "lower," "above," "upper," and the like, may be used herein for ease of description to describe one element or feature in relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein may be interpreted accordingly.

Example embodiments of the present inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the present inventive concepts should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of example embodiments.

It will be understood that although the terms "first," "second," etc. may be used herein to describe various elements, these elements should not be limited by these terms. These terms are only used to distinguish one element from another. Thus, a "first" element could be termed a "second" element without departing from the teachings of the present embodiments.

Unless otherwise defined, all terms (including technical and scientific terms) used herein have the same meaning as commonly understood by one of ordinary skill in the art to which this present inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

While certain features of the described implementations have been illustrated as described herein, many modifications, substitutions, changes, and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components, and/or features of the different implementations described.

What is claimed is:

1. A speaker module comprising:

a first sidewall opposite a second sidewall, the first sidewall forming a radio frequency transmissive window adapted to form a portion of an electronic device housing and the second sidewall including at least one port aperture to receive an electrical connection for at least one speaker; and a first end wall opposite a second end wall, the first end wall configured to integrate a flexible antenna element for receiving radio frequency signals through the radio frequency transmissive window, wherein the first sidewall, the second sidewall, the first end wall, and the second end wall form an enclosure to house the at least one speaker and the speaker module provides a structural support member for a cover glass of a display device seated in the electronic device housing, wherein the first sidewall includes a first curved sidewall portion having a first radius of curvature and a second curved sidewall portion having a second radius of curvature, the second curved sidewall portion being aligned parallel to the first curved sidewall portion to form the radio frequency transmissive window having a third radius of curvature to complement the first radius of curvature and the second radius of curvature, the first and second radii of curvatures arching into a center portion of an edge of the electronic device housing formed by the third radius of curvature of the radio frequency transmissive window.

2. The speaker module of claim 1, further comprising:

a front wall opposite a rear wall, the front wall including an aperture opening to receive the at least one speaker and the rear wall configured to provide structural support for a rear surface of the electronic device housing.

3. The speaker module of claim 1, wherein the speaker module provides at least:

a decorative edge for an electronic device housing;

a structural support member for the electronic device housing; and at least one mounting member for the flexible antenna element.

4. The speaker module of claim 1, wherein the radio frequency transmissive window is integrally formed with a metal enclosure to form a continuous edge of the electronic device housing.

5. The speaker module of claim 1, wherein the flexible antenna element comprises a flexible cable mounted to the speaker module on the first end wall.

6. The speaker module of claim 1, wherein the first curved sidewall portion, the second curved sidewall portion, and the radio transmissive window are coupled to form a continuous beveled edge of the electronic device housing.

7. The speaker module of claim 1, wherein the electronic device housing is configured to enclose a tablet device.

8. A portable electronic device comprising:

at least one processor configured to access memory;

at least one communications interface;

at least one transceiver configured to send and receive wireless signals;

at least one flexible antenna element;

a display;

at least one speaker mounted in a speaker module;

a first enclosure housing the speaker module, the first enclosure including, a first sidewall opposite a second sidewall, the first sidewall forming a radio-frequency-transparent element and the second sidewall including at least one port aperture to receive an electrical connection;

a first end wall opposite a second end wall, the first end wall configured to integrate the flexible antenna element for receiving radio frequency signals through the radio-frequency-transparent element, wherein the first sidewall, the second sidewall, the first end wall, and the second end wall form the first enclosure to house the at least one speaker, wherein the first sidewall includes a first curved sidewall portion having a first radius of curvature and a second curved sidewall portion having a second radius of curvature, the second curved sidewall portion being aligned parallel to the first curved sidewall portion to form an edge of the radio frequency-transparent element, the edge of the radio frequency-transparent element having a third radius of curvature to complement the first radius of curvature and the second radius of curvature; and a second enclosure configured to receive the first enclosure, the second enclosure integrating the first sidewall of the first enclosure into a first cavity formed by a beveled edge of the second enclosure.

9. The portable electronic device of claim 8, wherein the second curved sidewall portion supports a conductive rear surface of the portable electronic device.

10. The portable electronic device of claim 8, wherein the speaker module provide at least:

a decorative edge for the portable electronic device;

a structural support member for the portable electronic device; and at least one mounting member for the flexible antenna element.

11. The portable electronic device of claim 8, further comprising a rear surface coupled to the first enclosure and the second enclosure to provide structural support for the display, the first enclosure, and the second enclosure.

12. The portable electronic device of claim 8, wherein the first enclosure is constructed of a non-conductive material that allows radio frequency signals to be transmitted to the flexible antenna element;

the second enclosure is constructed of a conductive material, wherein the first enclosure and the second enclosure are coupled to form at least one continuous decorative edge of the portable electronic device.

13. The portable electronic device of claim 8, wherein the flexible antenna element comprises a cable mounted to the speaker module, the flexible antenna element being arranged to receive radio frequency signals through the first radio-frequency-transparent element.

14. An enclosure for a portable tablet computing device, comprising:

a first cover portion having a first beveled sidewall portion; and a second cover portion having a second beveled sidewall portion, the second beveled sidewall portion being aligned with the first beveled sidewall portion to form a continuous sidewall, the second cover portion including a radio frequency transmissive window on an edge of the second cover portion, the radio frequency transmissive window being coupled to a speaker module housed in the enclosure to form a portion of a continuous beveled edge of the enclosure, wherein the speaker module provides a structural support member for a cover glass of a display device seated in the enclosure, wherein the first beveled sidewall portion and the second beveled sidewall portion are adapted to dispose the radio frequency transmissive window between the first beveled sidewall portion and the second beveled sidewall portion, the first beveled sidewall portion having a first radius of curvature, the second beveled sidewall portion having a second radius of curvature, and the radio frequency transmissive window having a third radius of curvature to complement the first radius of curvature and the second radius of curvature to form the continuous sidewall.

15. The enclosure of claim 14, wherein the radio frequency transmissive window extends in a direction along a longitudinal line along the portion of the edge of the enclosure.

16. The enclosure of claim 14, wherein the second radius of curvature is the same as the first radius of curvature.

17. The enclosure of claim 14, wherein the radio frequency transmissive window is aligned to house a flexible antenna element arranged to receive radio frequency signals through the radio frequency transmissive window.

18. The enclosure of claim 14, wherein the enclosure is composed of conductive material and the radio frequency transmissive window is composed of non-conductive material, wherein the radio frequency transmissive window is integrally formed on a sidewall of a speaker module of the portable tablet computing device.

* * * * *